United States Patent [19]

Ahlstone

[11] Patent Number: 4,618,285

[45] Date of Patent: Oct. 21, 1986

[54] BUOYANT RING GASKET INSTALLATION TOOL

[75] Inventor: Arthur G. Ahlstone, Ventura, Calif.

[73] Assignee: Shell Offshore Inc., Houston, Tex.

[21] Appl. No.: 703,013

[22] Filed: Feb. 19, 1985

[51] Int. Cl.[4] ..... B63C 11/00

[52] U.S. Cl. ..... 405/191; 29/235; 29/451; 405/188; 405/195

[58] Field of Search ..... 405/188, 190, 191, 195, 405/169, 185; 166/338, 340; 277/1, 9, 9.5; 251/1 R, 1 A, 1 B; 29/235, 451

[56] References Cited

U.S. PATENT DOCUMENTS

| | | | |
|---|---|---|---|
| 3,350,103 | 10/1967 | Ahlstone | 277/9 |
| 3,463,226 | 8/1969 | Johnson | 405/191 |
| 4,386,659 | 6/1983 | Shotbolt | 405/169 |
| 4,417,830 | 11/1983 | Shotbolt | 405/195 |
| 4,478,586 | 10/1984 | Gentry et al. | 405/195 |
| 4,515,376 | 5/1985 | Okamuro | 277/9.5 |

FOREIGN PATENT DOCUMENTS

| | | | |
|---|---|---|---|
| 2065065 | 6/1981 | United Kingdom | 405/191 |

*Primary Examiner*—Cornelius J. Husar
*Assistant Examiner*—Kristina I. Hall
*Attorney, Agent, or Firm*—Paul I. Douglas

[57] ABSTRACT

A method and apparatus are described for the installation and removal of a ring gasket from a ring gasket retainer assembly which forms a part of an underwater wellhead connection. A buoyant ring gasket installation tool, tethered to an underwater vehicle, carries the gasket to the wellhead connection. Due to the buoyancy of the installation tool it floats above the underwater vehicle. By proper placement of the tool beneath an opening defined upwardly through the wellhead connection the tool may float the ring gasket upwardly through the opening and position the ring gasket properly with respect to the ring gasket retainer assembly, which may then be actuated to retain the gasket within the underwater wellhead connection.

17 Claims, 8 Drawing Figures

34
41
40
35
29
30
59
42
36
48
2
47
45
10
18
50
2
12
23
59
33
19
67

FIG. 2
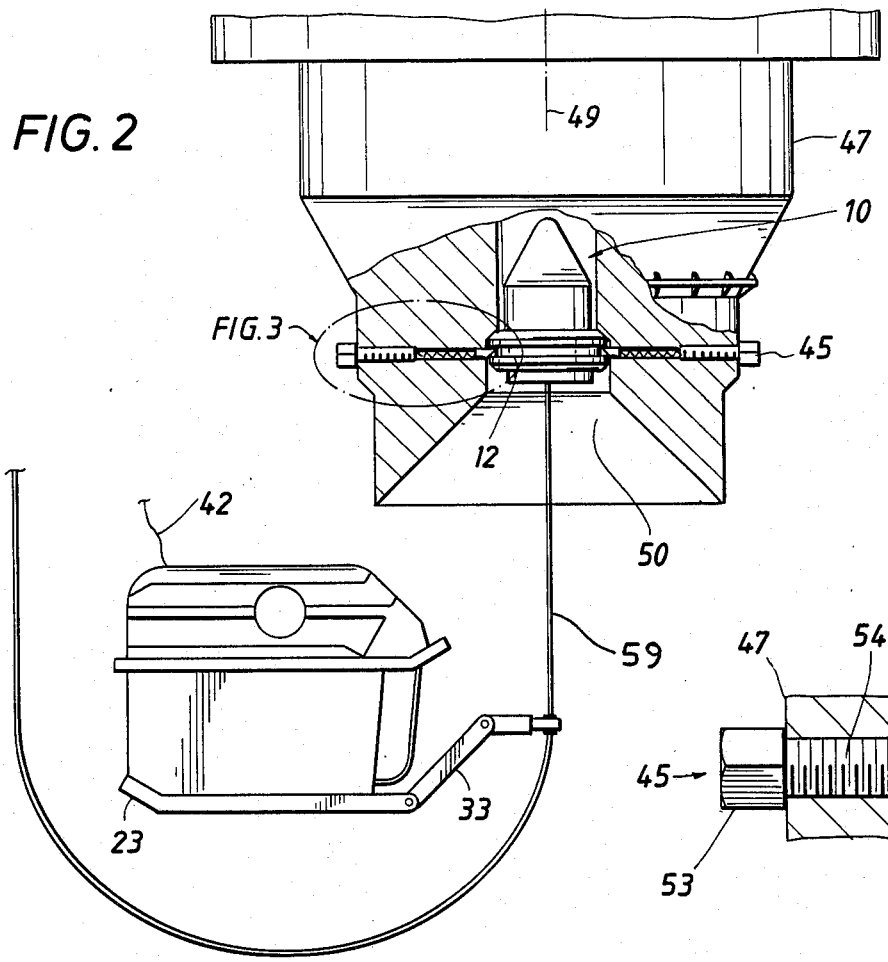
FIG. 3
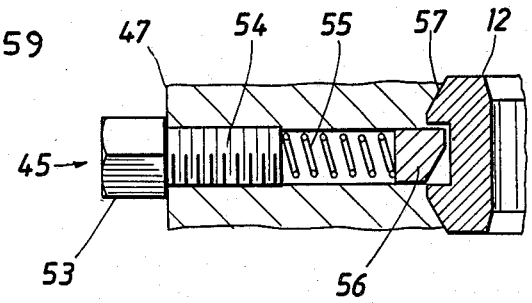
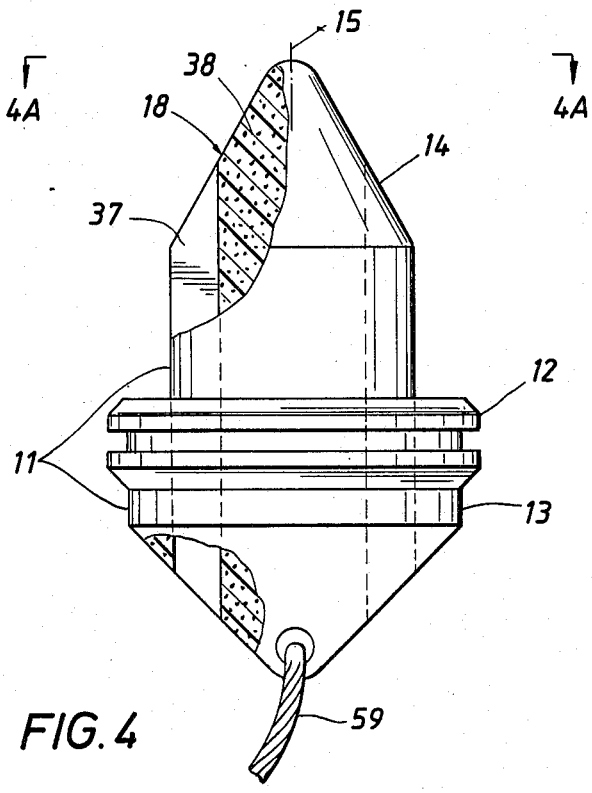
FIG. 4
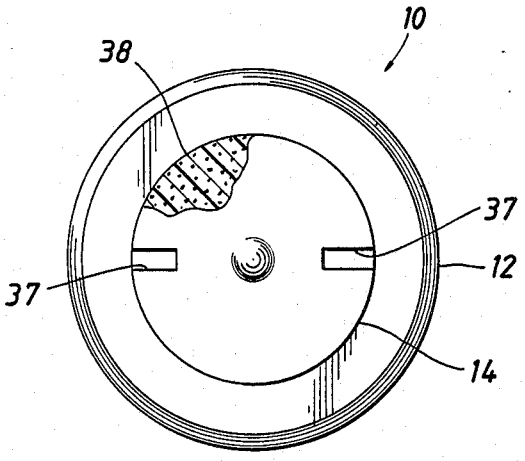
FIG. 4A

FIG. 5
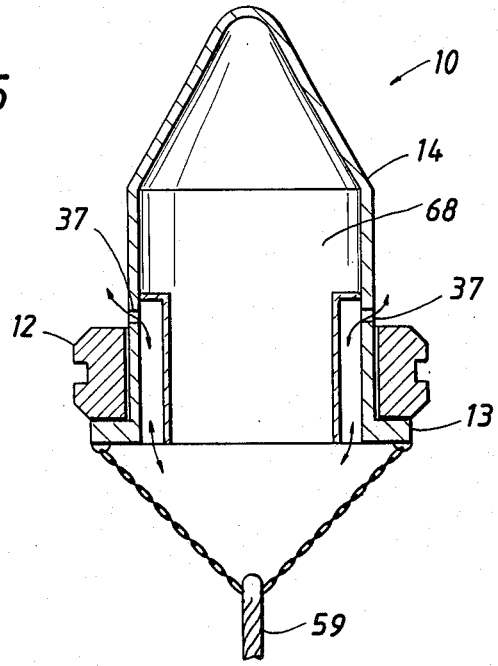
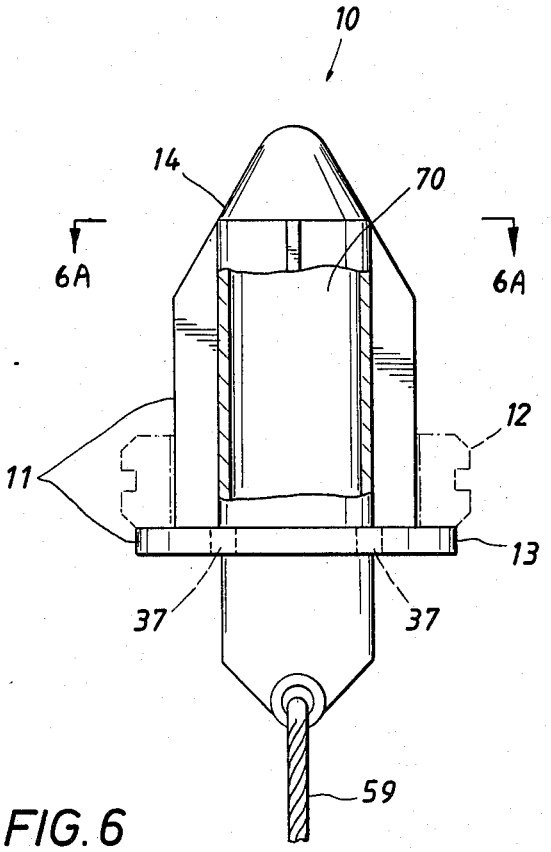
FIG. 6
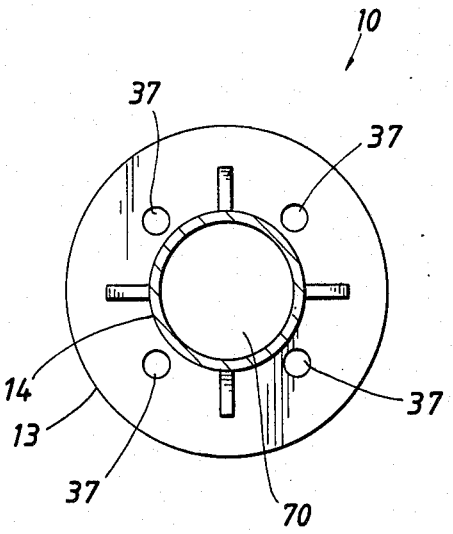
FIG. 6A

BUOYANT RING GASKET INSTALLATION TOOL

BACKGROUND OF THE INVENTION

1. Field of the Invention

The present invention relates to an apparatus for use in replacing a ring gasket carried by a subsea wellhead connector near the ocean floor.

2. Description of the Prior Art

In the drilling of oil and gas wells at an underwater site, a coupling is used for connecting subsea wellhead components to one another in sealed or pressure tight relation. It is usual for the upper portion of the coupling to contain a seal or ring gasket retained in place by a suitable device, this ring gasket being brought into sealing relation with a lower device previously installed at the underwater location. The ring gasket used in the coupling may commonly be designated as a "RX", "CX", "AX" or "VX" ring gasket depending upon the manufacturer of the gasket.

When the underwater coupling is disconnected, it is desirable to replace the previously installed ring gasket with a new one to insure a pressure tight fit upon reengagement of the coupling assembly. It is also desirable to inspect the surface of the old gasket for unusual deformations that would indicate damage to the sealing shoulders which mate with the gasket. After the underwater coupling is disconnected, the entire upper portion of the wellhead connector coupling with its attached ring gasket may be retrieved to the deck of a surface vessel conducting the well operations.

The ring gasket is usually removed from a ring gasket retainer assembly, such as the one disclosed in U.S. Pat. No. 3,350,103, entitled "Seal Ring Holding Device", issued Oct. 31, 1967 to A. G. Ahlstone. The ring gasket is removed by disengaging a split ring from a circumferential groove formed in the outer surface of the ring gasket.

In shallow water depths, the retrieval operation does not cause an unnecessary amount of downtime. However, in deeper waters, to retrieve the ring gasket retainer assembly all the way to the surface in order to remove the old ring gasket would require considerable time and entail great expense because of the large cost of offshore operations. Even in shallow waters removal by divers is impractical due to the weight (50–80 lbs). of the ring gaskets normally used for subsea connections.

Accordingly, it is desirable to present a method and apparatus for installing a new ring gasket into a subsea coupling, without having to retrieve the coupling to the surface along with the thousands of feet of pipe to which it is connected at a cost of up to a million dollars. It is also desirable to retrieve the previously installed ring gasket for inspection and from a depth generally below that at which a diver can operate, say, 5,000 feet or more.

SUMMARY OF THE INVENTION

The apparatus of the present invention comprises a buoyant ring gasket installation tool that carries a new ring gasket from the surface to a disconnected subsea coupling. The ring gasket installation tool may also carry the previously installed ring gasket back to the surface. In this manner, the coupling that carries the previously used ring gasket does not have to be retrieved to the surface in order to install and/or inspect the ring gasket(s), saving considerable expense.

The buoyant tool carries the ring gasket by having a central body section insertable up through an opening defined through the ring gasket, and an outwardly-extending shoulder formed near the lower end of the central body section. This shoulder prevents the ring gasket from dropping off the tool.

An underwater vehicle tows the buoyant tool down through the water until the tool is positioned below an opening defined in the subsea coupling that contains the ring gasket retainer assembly. The tool is then allowed to float upwardly, until the new ring gasket becomes seated in the existing ring gasket retainer assembly. The tool also is capable of returning a previously used ring gasket to the surface.

The buoyant tool is preferably connected to one end of a towing cable, hook, or other device. A portion of the cable is gripped by a manipulator arm of the underwater vehicle. The vehicle is usually controlled from a surface location by means of a power and signal transmitting cable depending downwardly from the surface.

It is an object of the present invention to provide a device which can install a new ring gasket into a coupling underwater positioned near the ocean floor.

It is a further object of the present invention to provide a device which can retrieve a previously installed ring gasket from the coupling to the surface.

These and other features, objects, and advantages of the present invention will become apparent from the following detailed description, wherein reference is made to the Figures in the accompanying drawing.

BRIEF DESCRIPTION OF THE DRAWINGS

FIG. 2 is a schematic representation of the tool after floating upwards into the wellhead connector.

FIG. 3 is a schematic representation of the ring gasket retainer assembly.

FIGS. 4 and 4A are a front and top view of a ring gasket installation tool formed from syntactic foam.

FIG. 5 is a schematic representation of a ring gasket installation tool, which obtains its buoyancy from trapped air carried within the body of the tool.

FIGS. 6 and 6A are a side and top view of a ring gasket installation tool which utilizes pressurized gas for buoyancy.

DESCRIPTION OF THE PREFERRED EMBODIMENT

Figure 1:
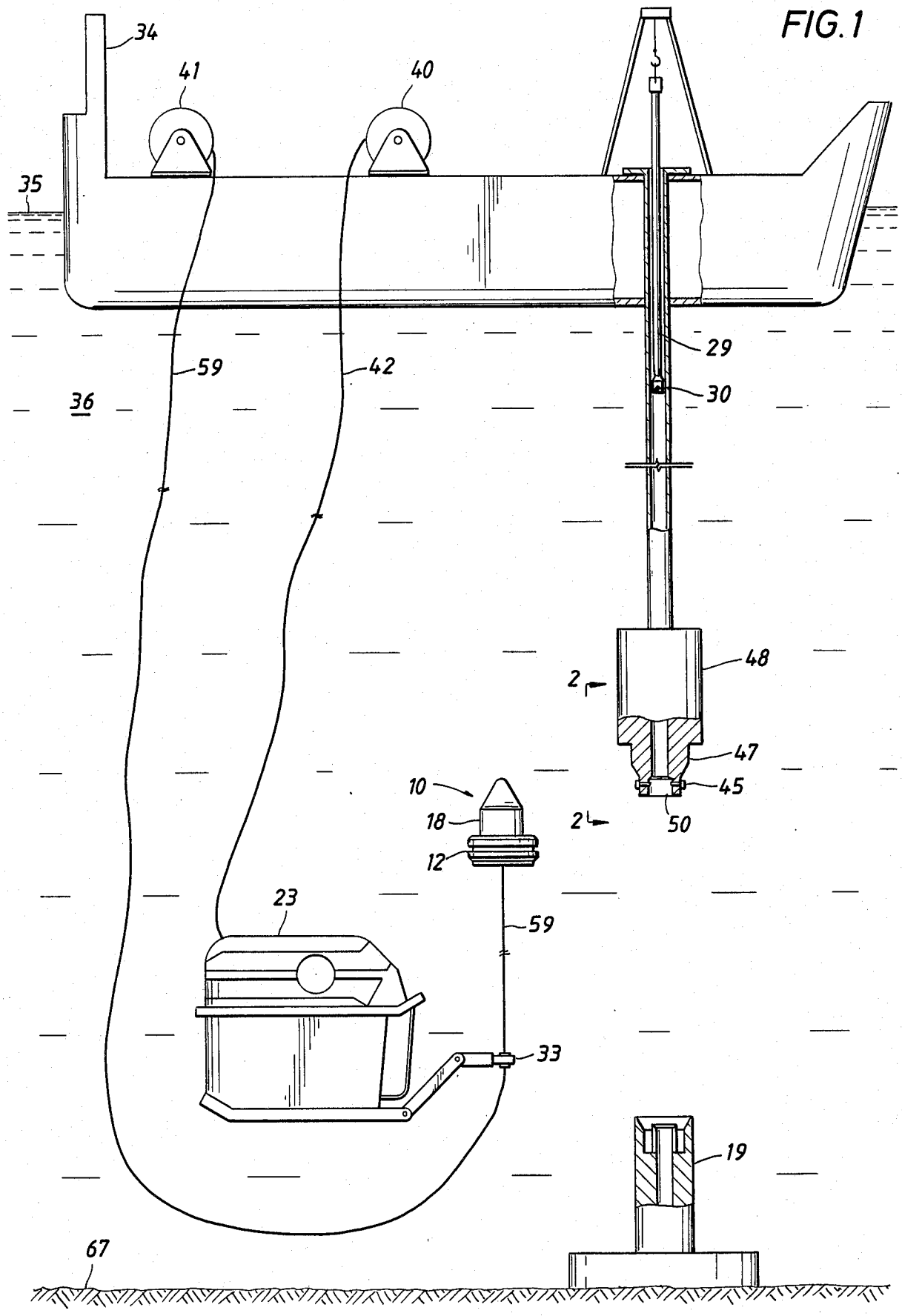
FIG. 1 is a schematic representation showing the tool carried by the underwater vehicle prior to being floated upwards into a wellhead connector.

Referring to FIG. 1 a ring-gasket installation tool 10 of the present invention is shown carring a ring gasket 12 about its outer surface. Buoyant material means 18, one form of which is well known to the art such as syntactic foam, supply positive buoyancy to the tool 10 in order to maintain the tool 10 positively buoyant when carrying the ring gasket 12. As a result of this positive buoyancy the tool 10 remains positioned above an underwater vehicle 23 that is operatively engaged to a cable 59 attached to the lower portion of tool 10. A manipulator arm 33, carried by the underwater vehicle 23, grips the cable 59. Alternatively, the manipulator arm 33 may operatively engage the lower part of the tool 10 in the event that a cable 59 is not employed.

The underwater vehicle 23 is supplied power by means of a power and signal transmission cable 42 which is controlled from a winch 40 carried by a vessel 34 which floats upon the surface 35 of a body of water 36. Cable 59 may extend beyond the manipulator arm 33 connection point upwardly through the body of water 36 to another winch 41 carried by the vessel 34.

The vessel 34 is shown with a pipe assembly 48, such as a marine drilling riser well known to the art, suspended from the vessel 34. A drill string 29 which carries a drill bit 30 at its lower end is shown depending downward through a portion of the pipe assembly 48. A wellhead connector 47 is carried at the lower end of pipe assembly 48. The wellhead connector 47 is provided with an axial opening defined upwardly through the connector 47 and carries therein a ring gasket retainer assembly 45. The ring gasket retainer assembly 45 is capable of retention of a ring gasket 12 against landing shoulders 57 (FIG. 3) formed within the wellhead connector 47 and forming a portion of a pressure-tight coupling. The other end of this pressure-tight coupling is carried by cooperating elements of a subsea equipment assembly 19 located underwater such as at the bottom 67 of the body of water 36. The subsea equipment assembly 19 or the wellhead assembly may include guide base, guide structure, wellhead housings and casing hangers well known to the art.

The underwater vehicle 23 is shown in the process of carrying the ring gasket 12 toward the wellhead connector 47 in order float the ring gasket installation tool 10 with its ring gasket 12 upwardly into the wellhead connector 47 opening 50 to allow the ring gasket 12 to contact the ring gasket retainer assembly 45. Once the ring gasket 12 is installed within the wellhead connector 47 the pipe assembly 48 may be lowered from the vessel 34 to contact the subsea equipment assembly 19 in order to complete the pressure tight coupling between the pipe assembly 48 and the subsea equipment assembly 19.

Referring now to FIG. 2, the tool 10 has been floated upwardly within the wellhead connector 47 opening 50. The ring gasket retainer assembly 45, which is now positioned adjacent the gasket 12, may be actuated hydraulically from the vessel 34 (FIG. 1), to secure the gasket 12 to the wellhead connector 47. Alternatively, the manipulator arm 33 of the underwater vehicle 23 may be positioned adjacent the hex heads 53 (FIG. 3) of the ring gasket retainer assembly 45 to thereafter engage and turn the hex heads 53 of the retainer assembly 45 until the ring gasket 12 is secured within the wellhead connector 47. To turn the hex heads 53 the manipulator arm 33 of the underwater vehicle 23 may be disconnected from the cable 59 to allow the manipulator arm 33 of the vehicle 23 to actuate the hex heads 53 of the retainer assembly 45.

The underwater vehicle 23 may carry visual monitoring equipment such as a TV camera (not shown) in order to properly position the tool 10 substantially centrally beneath the central vertical axis 49 of the wellhead connector 47.

The power-and-signal transmission cable 42 connected to the underwater vehicle 23 allows the directional thrusters carried by the underwater vehicle 23 to be powered and operated from a surface 35 location. The operation of the underwater vehicle 23 may be observed visually at the surface 35 by means of the TV equipment (not shown) normally carried by the underwater vehicle 23. In this fashion the underwater vehicle 23 may be selectively controlled from the surface 35 location.

As shown in FIG. 3, the retainer assembly 45 may employ and operate elements as set forth in U.S. Pat. No. 3,350,103, entitled "Seal Ring Holding Device", issued Oct. 31, 1967 to A. G. Ahlstone. When turned, a hex head 53 attached to a screw 54 drives helical spring 55 which contacts a retainer ring 56. The retainer ring 56, shown in cross section, is formed from a split ring positioned radially outward from the gasket 12. Actuation by the underwater vehicle 23 of a series of hex heads 53 placed circumferentially about the wellhead connector 47 so as to move screws 54 toward the ring gasket 12, causes the retainer ring 56 to become engaged with a circumferential groove defined in the outer elements of the gasket 12. This engagement allows the gasket 12 to be held in position adjacent the landing shoulder 57.

Alternatively, the ring gasket 12 may be allowed to fall away from the landing shoulder 57 and down through the opening 50 (FIG. 2), if the hexheads 53 are actuated in a direction to cause the retainer ring 56 to increase in diameter away from contact with the outer elements of the ring gasket 12.

A preferred embodiment of the ring gasket installation tool 10 is shown in FIGS. 4-4A. The tool 10 consists of a centralizer body means 11, which has a centralizer portion 14 and shoulder means portion 13. Both portions 13, 14 preferably have a common central vertical axis 15.

The centralizer portion 14 has an outer diameter less than the inner diameter of the ring gasket 12, to prevent the ring gasket 12 from substantial lateral movement toward and away from the central vertical axis 15. The shoulder means portion 13 has an outer diameter greater than the inner diameter of the ring gasket 12, in order to form means to hold the ring gasket 12 on the tool 10. The shoulder means portion 13 outer diameter is less than the inner diameter of the wellhead connector 47 opening 50. Further, the shoulder means portion 13 may be formed from any combination of outwardly extending ledges, rings, or dogs well known to the art. If in the form of a ledge, as shown, the ledge may be continuous or discontinuous in the form of ledge segments.

More specifically, the centralizer portion 14 and the shoulder means portion 13 have a longitudinal axis 15 coaxial with the axis of the surface of revolution that envelopes the outer surface of portions 13, 14 of the centralizer body means 11. The outer surface of the surface of revolution of the centralizer portion 14 defines an outer diameter less than the inner diameter of the ring gasket 12. The outer surface of a surface of revolution of the shoulder means portion 13 defines an outer diameter greater than the inner diameter of the ring gasket 12, but less than the inner diameter of the wellhead connector 47 opening 50.

In one embodiment the buoyant materials means 18 may take the form of a gas such as air contained within at least one portion of the centralizer body means 11. As shown in FIG. 4, the gas may be retained interstitially within foam material 38, such as Eccofloat TG-28A foam, which has an average density of 29 lbs. per cubic foot. This material is available from Emerson and Cumings, Inc., 869 Washington Street, Canton, Mass., 02021. As shown in FIG. 5, the gas may take the form of trapped air 68 contained by the wall of the centralizer portion 14 of the tool 10. As shown in FIG. 6, pressurized gas 70 may be contained within a pressurized cylinder which forms a portion of the centralizer portion 14.

Referring to FIGS. 4, 5, and 6 and 6A the centralizer body means 11 includes at least one opening which defines a fluid passage 37 through at least the shoulder portion means 13 of the centralizer body means 11.

Depending upon the configuration of the tool 10 this allows water 36 to flush backward and forward through the fluid passage 37 as the tool 10 is floated upward into the wellhead connector 47 opening 50. In this fashion the water 36 that would previously have been trapped within the pipe assembly 48 may be allowed to pass downward through the fluid passage 37 as the tool 10 is floated upward into the wellhead connector 47, or as the pipe assembly 48 moves vertically due to vertical surge or heave of the vessel 34 from waves which impact the vessel 34.

Depending upon the design of the centralizer body means 11, at least one opening which defines a fluid passage 37 through or alongside the centralizer portion 14 of the centralizer body means 11 from top to bottom may be provided. The centralizer portion 14 fluid passage 37 may be placed in communication with the fluid passage 37 defined through the shoulder portion 13.

In operation, above the surface 35 of the body of water 36 the ring gasket 12 is mounted upon the buoyant ring gasket installation tool 10, the installation tool 10 being operatively engaged by the underwater vehicle 23. The underwater vehicle 23, ring gasket 12 and buoyant ring gasket installation tool 10 may then be powered or lowered downwardly through the water 36 together to a location adjacent connector 47 of the pipe assembly 48 deep in the ocean. The underwater vehicle 23 supplies a downward force to the tool 10 to overcome the positive buoyancy of the tool 10. The tool 10 will be typically engaged to the underwater vehicle 23 by means of the cable 59 by a hook or otherwise.

The tool 10 and the ring gasket 12 may then be transported from the location adjacent the pipe assembly 48 to a position located substantially centrally beneath the wellhead connector 47 opening 50. By placing the tool 10 in this position, the tool 10 may be allowed to float upward into the wellhead connector 47 opening 50 as the underwater vehicle 23 moves upwardly towards the wellhead connector 47 opening 50.

Alternatively, the tool 10 may be positioned below the wellhead connector 47 opening 50 and the cable 59 may then be released by the underwater vehicle 23. The underwater vehicle 23 may be used at this time to actuate the ring gasket retainer assembly 45 to secure the ring gasket 12 to the wellhead connector 47. After the underwater vehicle 23 actuates the ring gasket retainer assembly 45 it may again operatively engage the cable 59.

After the ring gasket 12 is connected to the wellhead connector 47 the tool 10 may be moved downwardly out of the wellhead connector 47 and to one side of the wellhead connector 47. The tool 10 at this point may be returned to the surface 35 of the body of water 36.

If the tool 10 is still secured to the underwater vehicle 23 by the cable 59, the tool 10 may be lowered from the opening 50 by lowering the underwater vehicle 23.

The connection of the ring gasket 12 to the wellhead connector 47 may be accomplished by actuation of the ring gasket retainer assembly 45, as mentioned earlier. If is not desired to return the tool 10 to the surface 35 after the ring gasket 12 is connected to the wellhead connector 47 the tool 10 may remain within the wellhead connector 47. The wellhead connector 47 may then be connected to the subsea equipment assembly 19. The rotatable drill bit 30 (FIG. 1) may then be lowered downward through the wellhead connector 47, until the drill bit 30 contacts the tool 10. The tool 10 may thereafter be removed from the wellhead connector 47 by drilling downwardly through the installation tool 10 to grind it into small pieces with the drill bit 30. The practicality of this method increases when a substantial portion of the tool 10 is formed from the foam material 38.

Of course, before a new ring gasket 12 may be installed within the wellhead connector 47, a previously installed gasket must be removed from the wellhead connector 47. This may be accomplished by disconnection of the gasket 12 from the ring gasket retainer assembly 45, with the gasket 12 subsequently being allowed to fall to the bottom of the water 36. Alternatively, the ring gasket 12 may be disconnected from the wellhead connector 47 and subsequently caught on the shoulder means 13 of another buoyant ring gasket installation tool 10 which has not carried a gasket 12 down to the wellhead connector 47.

Many variations and modifications may be made in the apparatus and techniques hereinbefore described, both by those having experience in this technology, without departing from the concept of the present invention. Accordingly it should be clearly understood that the apparatus and methods depicted in the accompanying drawings and referred to in the foregoing description are illustrations only and are not intended as limitiations on the scope of the invention.

I claim as my invention:

1. Method of attaching underwater a ring gasket to a ring gasket retainer assembly located in a submerged wellhead connector having an opening defined upwardly therethrough, said method employing the use of an underwater vehicle, said ring gasket mounted on a buoyant ring gasket installation tool, said tool operatively engaged in a buoyant manner to said underwater vehicle, said method comprising;

lowering said underwater vehicle, ring gasket, and buoyant ring gasket installation tool downwardly through the water together to a location adjacent said submerged wellhead connector, transporting said buoyant installation tool carrying said ring gasket from said location adjacent said wellhead connector to a position substantially centrally beneath said wellhead connector opening, floating said ring gasket and said buoyant tool upwardly into said wellhead connector opening into engagement therewith, and connecting said ring gasket to said wellhead connector.

2. The method of claim 1 including, after connecting said ring gasket to said wellhead connector, moving said tool downwardly out of said wellhead connector and to one side thereof.

3. The method of claim 1 including, after connecting said ring gasket to said wellhead connector, lowering said tool from said opening defined through said wellhead connector by lowering said underwater vehicle operatively engaged to said tool.

4. The method of claim 1 wherein the step of connecting said ring gasket to said wellhead connector further includes the step of, actuating said ring gasket retainer assembly to connect said ring gasket to said wellhead connector.

5. The method of claim 1 wherein the step of floating said ring gasket and said buoyant installation tool upwardly further includes the step of, raising said underwater vehicle operatively engaged to said tool upwardly.

6. The method of claim 1 wherein the step of floating said ring gasket and said buoyant installation tool upwardly further includes the step of, releasing said installation tool from operative engagement with said underwater vehicle.

7. The method of claim 1 including, prior to floating said ring gasket and said buoyant installation tool upwardly into said opening defined through said wellhead connector into engagement therewith, wherein the wellhead connector to which a ring gasket is to be attached is already provided with a previously installed ring gasket, the step of;

removing underwater said previously installed ring gasket.

8. The method of claim 7 including the steps of, disconnecting said previously installed ring gasket from said wellhead connector, and allowing said gasket to fall to the bottom of said water.

9. The method of claim 7 including the steps of, disconnecting said ring gasket from said wellhead connector, and catching said ring gasket on another of said buoyant ring gasket installation tools.

10. The method of claim 1 including the steps of, after connecting said ring gasket to said wellhead connector, providing said wellhead connector with a rotatable drill bit lowerable through said wellhead connector opening, and removing said installation tool by drilling downwardly through said installation tool with said drill bit.

11. A ring gasket installation apparatus adapted to be operatively engaged with an underwater vehicle, for moving a ring gasket having a circular inner diameter from a vessel carried upon the surface of a body of water to a ring gasket retainer assembly located within an opening defined through a submerged wellhead connector located at the lower end of a pipe assembly, said apparatus comprising:

centralizer body means having an upper centralizer portion and an outwardly extending lower shoulder means portion, said centralizer body means, when moving said ring gasket, having at least a positive buoyancy, said centralizer portion having an outer diameter less than the inner diameter of said ring gasket to allow said ring gasket to slide axially thereover, said shoulder means portion having an outer diameter greater than the inner diameter of said ring gasket to hold said ring gasket thereon, said shoulder means portion outer diameter less than the diameter of said wellhead connector opening, and attachment means connected to said centralizer body means operatively engageable with an underwater vehicle.

12. The apparatus of claim 11 wherein a portion of said centralizer body means comprises;

buoyant material means to maintain said centralizer body means positively buoyant when carrying said ring gasket.

13. The apparatus of claim 12 wherein said buoyant material means comprises a gas contained within at least one portion of said centralizer body means.

14. The apparatus of claim 11 wherein said centralizer body means includes at least one opening defining a fluid passage through said shoulder means portion of said centralizer body means.

15. The apparatus of claim 14 wherein said centralizer body means includes at least one opening defining a fluid passage through said centralizer portion of said centralizer body means, said fluid passage defined through said centralizer portion in fluid communication with said fluid passage defined through said shoulder portion means.

16. The apparatus of claim 11 wherein said underwater vehicle attachment means comprises;

a cable having two ends connected at one end to said centralizer body means said cable operatively engageable with a manipulator arm carried by said underwater vehicle.

17. The apparatus of claim 16 wherein the other end of said cable is connected to a winch carried by said vessel.

* * * * *